United States Patent [19]

Murai et al.

[11] Patent Number: 4,963,475

[45] Date of Patent: Oct. 16, 1990

[54] METHOD FOR PROCESSING SILVER HALIDE PHOTO-SENSITIVE MATERIAL

[75] Inventors: Kazuhiro Murai; Keiji Ohbayashi, both of Hino; Kaoru Onodera, Odawara, all of Japan

[73] Assignee: Konishiroku Photo Industry Co., Ltd., Tokyo, Japan

[21] Appl. No.: 331,022

[22] Filed: Mar. 28, 1989

Related U.S. Application Data

[63] Continuation of Ser. No. 40,487, Apr. 20, 1987, abandoned.

[30] Foreign Application Priority Data

Apr. 22, 1986 [JP] Japan ..... 61-92936

[51] Int. Cl.[5] ..... G03C 5/305

[52] U.S. Cl. ..... 430/467; 430/464; 430/460; 430/484; 430/485; 430/489; 430/490; 430/576; 430/600; 430/603

[58] Field of Search ..... 430/380, 393, 430, 440, 430/460, 551, 576, 600, 603, 464, 467, 484, 483, 489, 490

[56] References Cited

U.S. PATENT DOCUMENTS 3,752,670 8/1973 Needler et al. .
4,252,892 2/1981 Case .
4,264,721 4/1981 Shimano et al. ..... 430/557
4,322,493 3/1982 Shibaoka et al. ..... 430/489
4,555,482 11/1985 Inoue et al. ..... 430/576
4,713,321 12/1987 Mifune et al. ..... 430/581
4,774,166 9/1987 Sasaki et al. ..... 430/376
4,797,350 1/1988 Ohbayashi et al. ..... 430/380
4,801,516 1/1989 Ishikawa et al. ..... 430/380

FOREIGN PATENT DOCUMENTS 1080483 12/1954 France .
1210905 3/1960 France .

OTHER PUBLICATIONS

Research Disclosure No. 164, 12/77, pp. 60–63, #16480.
"Photographic Color Developer Compositions", pp. 60–61, P. Glafkides: Chimie et physique photographiques, 1967, 3rd ed. chapter 37, pp. 753–759.

*Primary Examiner*—Paul R. Michl
*Assistant Examiner*—Janet C. Baxter
*Attorney, Agent, or Firm*—Jordan B. Bierman

[57] ABSTRACT

A method of processing an imagewise exposed light-sensitive silver halide photographic material. The material contains a silver halide emulsion layer containing silver halide grains which are sensitized with a monomethine dye. The material is processed with a developer solution containing an aromatic primary amine color developing agent in the presence of at least one hydroxylamine derivative and at least one nitrogen containing heterocyclic mercapto compound.

17 Claims, No Drawings

METHOD FOR PROCESSING SILVER HALIDE PHOTO-SENSITIVE MATERIAL

This application is a continuation of application Ser. No. 040,487, filed Apr. 20, 1987, now abandoned.

FIELD OF THE INVENTION

The present invention relates to a method for processing silver halide photo-sensitive materials, in particular to a method for fast and stably processing silver halide photo-sensitive materials capable of preventing fog from increasing.

BACKGROUND OF THE INVENTION

In general, a silver halide color photo-sensitive material is provided with three kinds of silver halide color emulsion layer each selectively and spectrometrically sensitized so as to be sensitive to a blue light, a green light and a red light, respectively, applied on a support member. For example, a color negative photo-sensitive material is generally provided with a blue light-sensitive emulsion layer, a green light-sensitive emulsion layer and a red light-sensitive layer applied in this order from a side exposed. A bleachable yellow filter layer is disposed between the blue light-sensitive emulsion layer and the green light-sensitive emulsion layer to absorb a blue light passing through the blue light-sensitive emulsion layer. In addition, each emulsion layer is provided with other intermediate layers and a protective layer as the outermost layer for achieving various kinds of special object. Besides, for example a color printing paper photo-sensitive material is generally provided with a red light-sensitive emulsion layer, a green light-sensitive emulsion layer and a blue light-sensitive emulsion layer applied in this order from a side exposed. In addition, the color printing paper photo-sensitive material is provided with an intermediate layer, a protective layer and the like in addition to an ultraviolet ray-absorption layer for achieving a special object, respectively, in the same manner as in the color negative photo-sensitive material. It has been known that these emulsion layers can be arranged in a manner other than the above described. It has been known also that a sensitive emulsion layer consisting of two layers having a sensitivity in the substantially same wave length range to a light of each color is used as the emulsion layer. For these silver halide photo-sensitive materials for example a aromatic primary amine color developing agent is used as a color developing agent. Silver halide particles exposed are developed and a reaction between an oxidized product of the color developing agent and a dye forming coupler leads to the formation of a dye image. In this method, in general, in order to form a cyan, magenta or yellow dye image, a cyan, magenta or yellow dye-forming coupler is used, respectively.

Recently, a silver halide color photo-sensitive material (hereinafter referred to as a color sensitive material), which can be fast and stably processed, giving a high image quality, and being inexpensive, has been desired. In particular, a fast processable silver halide color photo-sensitive material has been desired.

That is to say, a silver halide photo-sensitive material has been subjected to a running process in an automatic developing machine placed in each developing shop but it has been required to develop and return the silver halide photo-sensitive material to a user within its receipt data as one of improved services for the user.

Recently, it is being required even to return the silver halide photo-sensitive material to the user within several hours from its receipt. Thus, the rapid development of an increasingly fast processable silver halide color photo-sensitive material is being desired.

Although in general the formation of such a dye image comprises a color developing process, a bleaching process, a fixing process (or a bleach fixing process) and a washing process of an exposed color sensitive material, it is considerably important in respect of technique and practical use for a color printing paper requiring a particularly fast processability to shorten a time period for the color developing process.

In order to speedily carry out the color developing process, measures, such as a raise of developing temperature, a reduction of a concentration of a bromide ion, which is a main ingredient of a development inhibitor, a raise of a concentration of a color developing agent and a raise of pH, have been most usually taken.

The speed-up of the color developing process can be achieved also by processing a silver halide photo-sensitive material containing silver halide particles substantially comprising silver chloride in the presence of a bromide ion in a color developer.

However, in the event that the speed-up of the color developing process is carried out by the above described various kinds of measure, a problem occurs in that a slight change of conditions (temperature, pH, time and the like), a slight change of composition (concentration of bromide ion and concentration of a color developing agent) and contamination of a minute amount of bleach fixing solution are apt to cause fogging.

On the other hand, recently it has been remarkably desired to remove benzyl alcohol as a dye formation-improving agent from a color developer in view of pollution control. If benzyl alcohol was removed from the color developer, a dye formation speed is reduced. That is to say, the color developing agent develops exposed silver halide particles, whereby a reacting capacity between the resulting oxidized substance of the color developing agent and a coupler is suddenly lowered to be difficult to obtain a high color.

It was found that such a problem (the reduction of color concentration) occurring in the event that benzyl alcohol was removed was particularly due to hydroxyl amine salt used in the color developer as a usual preservative.

It has been known that in the usual color developer the above described hydroxyl amine salt serves as a superior preservative for preventing the color developing agent from being oxidized with an air particularly in the event that it is used together with sulfite salts. Moreover, in the event that a color sensitive material was processed with a color developer containing benzyl alcohol at pH of about 10, its influence upon the coloring capacity was remarkably small.

However, since hydroxyl amine peculiarly reduces the color concentration in the event that the developing process is carried out with a color developer without containing benzyl alcohol, a method of fast color developing capable of reducing bad influences upon the maximum density and the gradation by using other preservatives in place of hydroxyl amine is necessary.

On the other hand, some preservatives for the color developer have been proposed in place of hydroxyl amine. Among them hydroxyl amine derivatives having at least one substituent to the nitrogen atom are useful as a compound having a sufficient preservative capacity without extremely reducing the coloring capacity even in the event that the concentration of color developer is sufficiently high and benzyl alcohol is not contained.

However, on the other hand, if such hydroxyl amine derivative is used in place of hydroxyl amine as a preservative in the event that the process is carried out with a color developer without containing benzyl alcohol, a dye image of a silver halide photo-sensitive material can reach the maximum density quickly but a disadvantage occurs in that the fog is apt to be generated when the dye image of the silver halide photo-sensitive material reached the maximum density.

It has been known that mercapto compounds are preferably used as a fog inhibitor. Although mercapto compounds are effective as a fog inhibitor, they exihibit no sufficient effect in an inhibition of such the fog that is apt to be generated in the event that the color developing process was speeded up in the above described manner.

SUMMARY OF THE INVENTION

The present invention was achieved in view of the above described state of art. Thus it is an object of the present invention to provide a method for processing a silver halide photo-sensitive material in which a pollution load is reduced by removing benzyl alcohol from a color developer and a dye image can be fast formed by carrying out a color developing process in the presence of a specific hydroxyl amine derivative, hereby restraining fog, with a reduced sensitivity or gradation fluctuation due to a change of pH.

Thus the present invention specifically relates to a method of processing a light-sensitive silver halide photographic material which comprises a step of processing an imagewise exposed light-sensitive silver halide photographic material comprising a support and, provided thereon, at least one silver halide emulsion layer containing silver halide grains which are sensitized with a sensitizing dye represented by general formula [I];

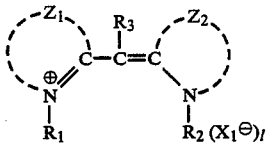

[I]

(wherein, $Z_1$ and $Z_2$ are independently represent a group of atoms necessary to complete a heterocyclic ring consisting of a thiazole, a benzothiazole, a selenazole, a benzoselenazole, a naphthoselenazole, a benzimidazole, a naphthoimidazole, a pyridine or a quinoline ring, wherein said heterocyclic ring may have a substituent; $R_1$ and $R_2$ are independently selected from a group consisting of an alkyl group, an alkenyl group and an aryl group; $R_3$ is selected from a group consisting of hydrogen atom, a methyl group and an ethyl group; $X_1$ is an anion and l is 0 or 1); with a color developer solution containing an aromatic primary amine color developing agent in the presence of at least one hydroxylamine derivative represented by general formula [II] or a water soluble salt thereof;

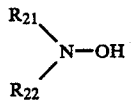

[II]

(wherein, $R_{21}$ and $R_{22}$ are independently selected from a group consisting of a hydrogen atom and an alkyl group having 1 to 4 carbon atoms which may have a substituent provided that $R_{21}$ and $R_{22}$ are not simultaneously hydrogen atoms and that $R_{21}$ and $R_{22}$ may be combined with each other to form a nitrogen-containing ring); and at least one nitrogen-containing heterocyclic mercaptocompound.

DETAILED DESCRIPTION OF THE INVENTION

Heterocyclic rings expressed by $Z_1$, $Z_2$ in said general formula [I] preferably include a thiazole-, a benzothiazol-, a naphthothiazol-, a selenazol-, a benzoselenazol- and a naththoselenazol ring, more preferably a thiazole-, a benzo- thiasol-, a selenazol- and a benzoselenazol ring, and most preferably a benzothiazol ring.

These rings may be substituted by various kinds of substituent, preferably halogen atoms, a hydroxyl group, a cyano group, aryl groups, alkyl groups, alcoxyl groups or alcoxycarbonyl groups, more preferably halogen atoms, a cyano group, aryl groups, alkyl groups of $C_1$ to $C_6$ or alcoxyl groups of $C_1$ to $C_6$, and most preferably halogen atoms, a cyano group, a methyl group, an ethyl group, a methoxy group and an ethoxy.

$R_1$ and $R_2$ are alkyl groups, alkenyl groups or aryl groups. However, alkyl groups expressed by $R_1$ and $R_2$ preferably include alkyl groups of $C_1$ to $C_6$, and most preferably an ethyl group, a propyl group and a butyl group. These alkyl groups may be substituted by various kinds of substituent, preferably a carboxylic group and a sulfonic group. In this case, salts may be formed between them and alkaline metal ions and an ammonium ion. At least one of $R_1$ and $R_2$ is preferably an alkyl group substituted by a sulfonic group. The alkenyl groups include an allyl group while the aryl groups include a phenyl group and the like.

$R_3$ is a hydrogen atom, a methyl group or an ethyl group, preferably a hydrogen atom.

$X^{\ominus}$ is an anion, preferably a chloride ion, a bromide ion, an iodide ion and a p-toluene sulfonic acid ion.

l is an integer of 0 or 1. In addition, l is 0 in the event that at least one of $R_1$ and $R_2$ is a group having a minus electric charge itself such as a carboxylic group and a sulfonic group.

Typical examples of a sensitizing dye expressed by the general formula [I] are below described but they are not restrictive.

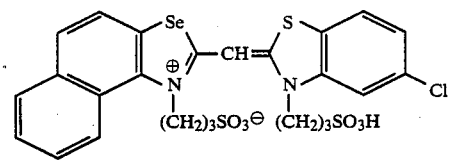

(I-1)

-continued
(I-2)
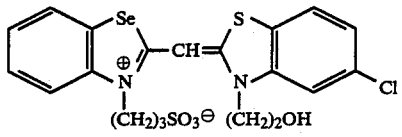
(I-3)
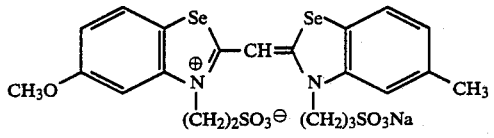
(I-4)
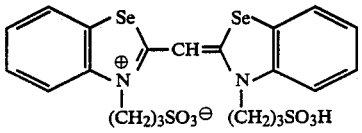
(I-5)
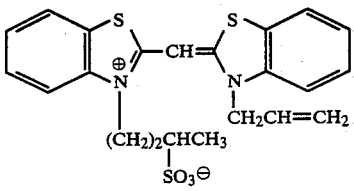
(I-6)
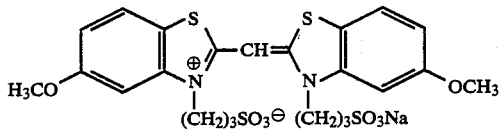
(I-7)
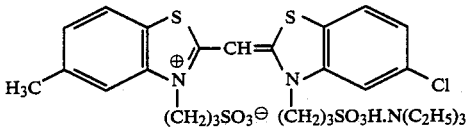
(I-8)
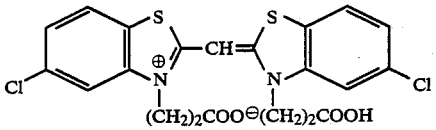
(I-9)
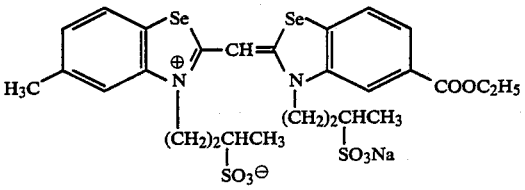
(I-10)
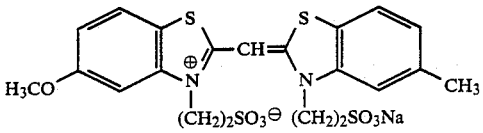
(I-11)
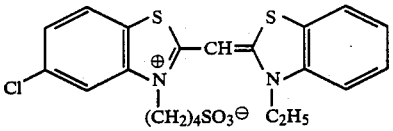
-continued
(I-12)
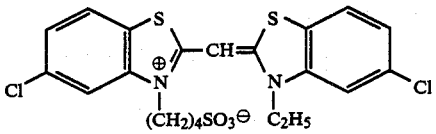
(I-13)
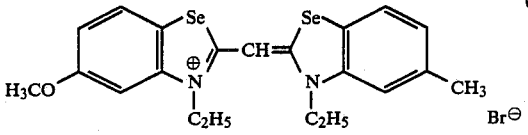
(I-14)
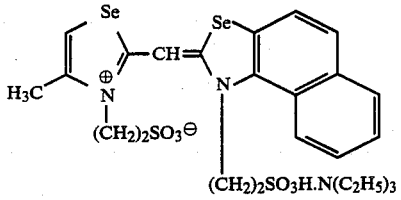
(I-15)
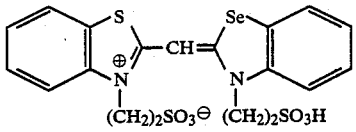
(I-16)
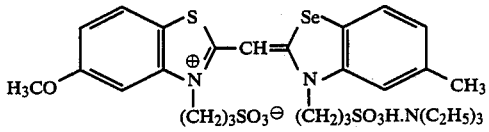
(I-17)
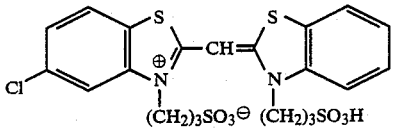
(I-18)
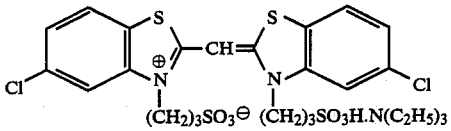
(I-19)
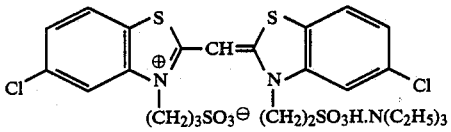
(I-20)
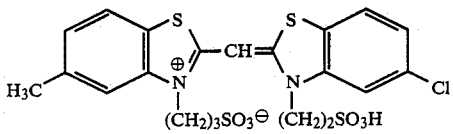
(I-21)
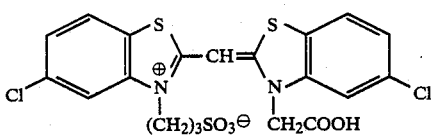

-continued (I-22)

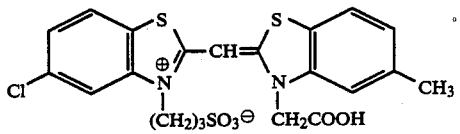

(I-23)

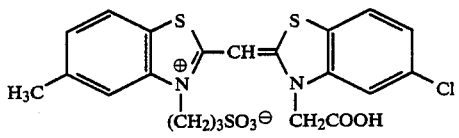

(I-24)

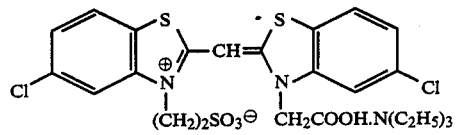

The sensitizing dye expressed by said general formula [I] according to the present invention can be easily synthesized in accordance with methods disclosed in for example BP No. 660,408 and U.S. Pat. No. 3,149,105.

In order to add the sensitizing dye expressed by said general formula [I] according to the present invention to a silver halide emulsion, the sensitizing dye is preferably dissolved in organic solvents, such as methanol and ethanol, which can be optionally blended with water.

The sensitizing dye may be added in every step of the process of manufacturing an emulsion, preferably in the chemical ageing step. In addition, a quantity of the sensitizing dye to be added is depend upon a kind of the sensitizing dye and a kind of the silver halide emulsion but the sensitizing dye is preferably added at a ratio of 0.01 to 0.5 g based on one mol of silver halide.

Although the hydroxyl amine derivatives used in the present invention are preferably added to the color developer solution, a system, in which the hydroxyl amine derivative of the present invention is previously incorporated in the sensitive material and the hydroxyl amine derivative of the present invention is supplied in the color developer by continuously processing the sensitive material, is also possible.

The hydroxyl amine derivative represented by general formula [II] includes, as preferable and non-limitative example those compounds listed below:

(II-1) $CH_3-N(CH_3)-OH$ (II-2) $C_2H_5-N(CH_3)-OH$ (II-3) $C_2H_5-N(C_2H_5)-OH$ (II-4) $(iso)C_3H_7-N(CH_3)-OH$ (II-5) $(n)C_3H_7-N(C_2H_5)-OH$ (II-6) $(n)C_3H_7-N(C_3H_7)-OH$ -continued (II-7) $H-N(CH_3)-OH$ (II-8) $H-N(C_2H_5)-OH$ (II-9) $CH_3-N(C_2H_4OH)-OH$ (II-10)

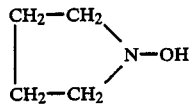

(II-11) $(iso\text{-}C_3H_7)_2N-OH$ (II-12) $(C_2H_5)(iso\text{-}C_3H_7)N-OH$ (II-13) $(CH_3-O-C_2H_4)(C_2H_5)N-OH$ (II-14) $(HOC_2H_4)_2N-OH$ (II-15) $(HO_3S-C_2H_4)(C_2H_5)N-OH$ (II-16) $(HOOC-C_2H_4)_2N-OH$ (II-17)

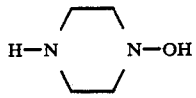

(II-18)

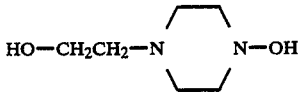

(II-19)

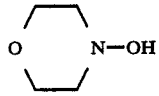

(II-20)

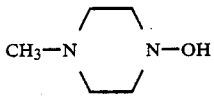

(II-21) $(CH_3)(CH_3OC_2H_4)N-OH$

-continued

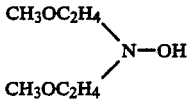
(II-22)

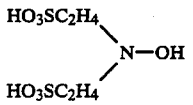
(II-23)

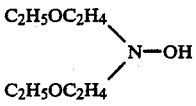
(II-24)

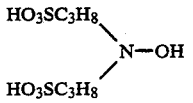
(II-25)

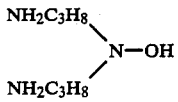
(II-26)

$HO-CH_2-NH-OH$ (II-27)

$CH_3-O-C_2H_4-NH-OH$ (II-28)

$HO-C_2H_4-NH-OH$ (II-29)

$HOOC-C_2H_4-NH-OH$ (II-30)

$HO_3S-C_2H_4-NH-OH$ (II-31)

$N_2H-C_3H_6-NH-OH$ (II-32)

$CH_3-O-C_2H_4-NH-OH$ (II-33)

The hydroxylamine derivative of the present invention can be used in the form of acid salt such as hydrochloride, sulfate, p-toluenesulfate, oxalate, phosphate, acetate and so forth.

The hydroxyl amine derivative or an acid salt thereof is used at an amount of 0.5 to 50 g, preferably 1 to 20 g, based on one liter of the color developer. In addition, although the above described hydroxylamine derivative can be used together with hydroxylamine salts as far as the effects of the present invention are not spoiled, the latter is added at a ratio of about 1 g or less, preferably 0.5 g or less, based on 1 liter of the color developer (calculated as $NH_2OH \cdot \frac{1}{2}H_2SO_4$).

In addition, when the hydroxylamine derivative is incorporated in the photo-sensitive material and the color developer is supplied with it by continuously processing the photo-sensitive material, the hydroxylamine is used at a ratio of 0.05 to 5 g, preferably 0.1 to 2 g, per 1 $m^2$ of the photo-sensitive material.

Nextly, nitrogen-containing heterocyclic mercapto compounds are described.

Heterocyclic rings in the nitrogen-containing heterocyclic mercapto compounds used in the present invention are preferably selected from a group consisting of an imidazoline ring, an imidazol ring, an imidazolone ring, a pyrazoline ring, a pyrazol ring, a pyrazolone ring, an oxazoline ring, an oxazole ring, an oxazolone ring, a thiazoline ring, a thiazol ring, a thiazolone ring, a selenazoline ring, a selenazole ring, a selenazolone ring, an oxadiazole ring, a thiadiazole ring, a triazole ring, a tetrazole ring, a benzimidazole ring, a benztriazole ring, an indazole ring, a benzoxaxole ring, a benzthiazole ring, a pyrazine ring, a pyrimidine ring, a pyridazine ring, a triazine ring, an oxazine ring, a thiazine ring, a tetrazing ring, a chinazoline ring, a phtharazine ring and polyazaindene rings (for example a triazaindene ring, a tetrazaindene ring, a pentazaindene ring and the like).

Of the above described nitrogen-containing heterocyclic mercapto compounds, mercapto oxadiazole, mercapto thiadiazole, mercapto triazole expressed by the following general formula [III] and mercapto tetrazole are preferably used:

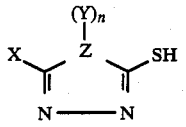

wherein X is selected from a group consisting of a hydrogen agom, an amino group, a hydroxyl group, a hydrazino group, an alkyl group, an alkenyl group, a cycloalkyl group, an aryl group, a $-NHCOR_1$ group, a $-NHSO_2R_1$ group or a $-R_2S$ group; Y is selected from a group consisting of hydrogen atom, an amino group, an alkyl group, an alkenyl group, a cycloalkyl group, an aryl group, a $-CONHR_3$ group, a $-COR_4$ group, a $-NHCOR_5$ group or a $-NHSO_2R_5$ group; Z is nitrogen atom, sulfur atom or oxygen atom; n is 1 when Z is nitrogen atom and 0 when Z is oxygen atom or sulfur atom; and $R_1$, $R_2$, $R_3$, $R_4$ and $R_5$ are independently selected from a group consisting of an alkyl group, an alkenyl group, a cycloalkyl group and an aryl group.

In more detail describing the general formula [III], the alkyl group expressed by X and Y is preferably selected from those containing 1 to 18 carbon atoms such as a methyl group, an ethyl group, a propyl group, a butyl group, an octyl group and a benzyl group. Cycloalkyl group is preferably selected from a cyclohexyl group, a cyclopentyl group and the like. In addition, the alkenyl group is preferably selected from those containing 2 to 18 atoms such as an allyl group and an octenyl group. Aryl group is selected, for example, from a phenyl group, a naphthyl group and the like.

Furthermore, the alkyl group expressed by $R_1$, $R_2$, $R_3$, $R_4$ and $R_5$ may preferably be linear or branched alkyl groups containing 1 to 18 carbon atoms such as a methyl group, an ethyl group, a propyl group, a butyl group and a hexyl group. The cycloalkyl group is preferably selected for example, from a cyclopentyl group, a cyclohexyl group and the like. The alkenyl group is preferably selected from those containing 2 to 18 carbon atoms such as an allyl group, an octenyl group and an octadecenyl group. The aryl groups are a phenyl group, a naphthyl group and the like.

Besides, alkyl groups, cycloalkyl groups, alkenyl groups and aryl groups expressed by said X, Y, $R_1$, $R_2$, $R_3$, $R_4$ and $R_5$ may have a substituent. Such substituent includes an alkyl group, a cycloalkyl group, an aryl group, an alkenyl group, a halogen atom, nitro group, cyano group, mercapto group, an amino group, a carboxyl group, a hydroxyl group and the like.

The compounds expressed by the general formula [III] according to the present invention show the following isomerization. The present invention includes also these isomers.

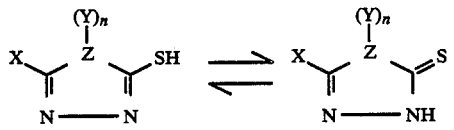

Concrete examples of the compounds expressed by the general formula [III] will be below described but they are not restrictive.

(General formulae III-1 to III-60)

Said compounds have been generally known and disclosed in for example Japanese Patent Unexamined Publication No. 107129/1976, Japanese Patent Unexamined Publication No. 102621/1973, Japanese Patent Unexamined Publication No. 59463/1980, Japanese Patent Unexamined Publication No. 124333/1984, and BP No. 1,204,623.

Further, the following heterocyclic mercapto compounds can also be mentioned as preferable examples of the present invention.

IV-1

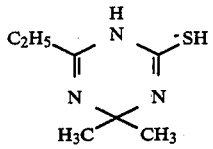

IV-2

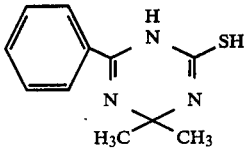

IV-3

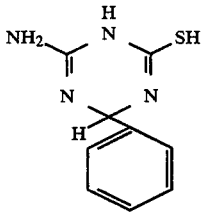

IV-4

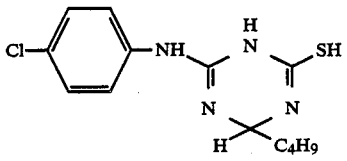

IV-5

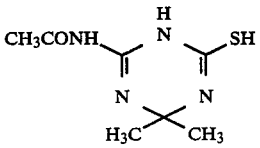

IV-6

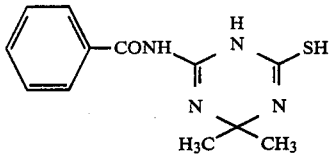

-continued

IV-7

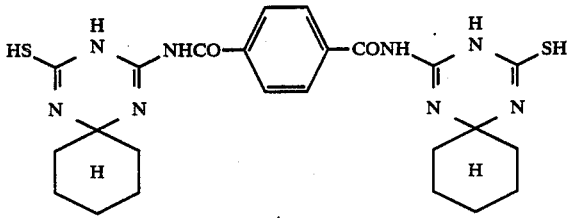

IV-8

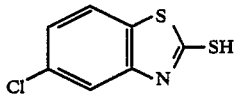

IV-9

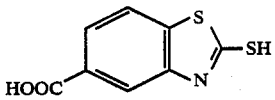

IV-10

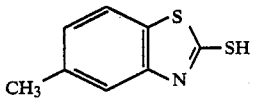

IV-11

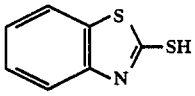

IV-12

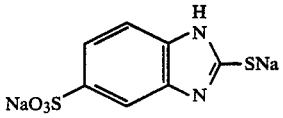

IV-13

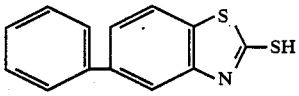

IV-14

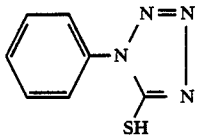

IV-15

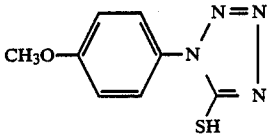

IV-16

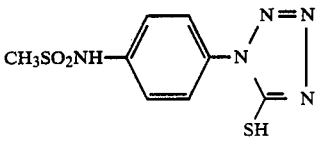

IV-17

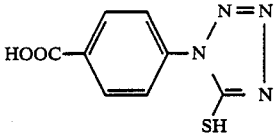

-continued

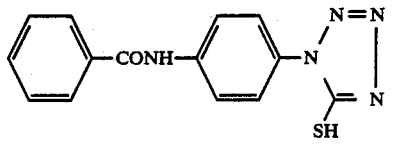

IV-18

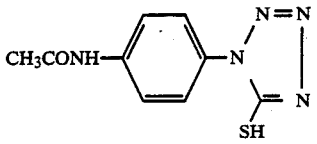

IV-19

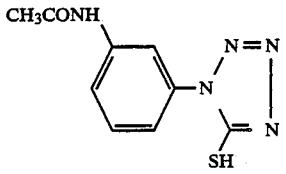

IV-20

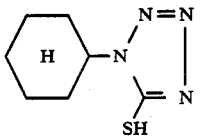

IV-21

The above-mentioned exemplified compounds can be synthesized in the light of, for example, J. Chem. Soc. [49], 1748 (1927); J. Org. Chem. [39], 2469(1965); Japanese Patent Unexamined Publication Nos. 89034/1975, 79436/1980, 102639/1976, 594635/1980; Ann. Chem. 44-3, 1954; Japanese Patent Publication No. 28496/1965; Chem. Ber. [20], 231(1887); U.S. Pat. No. 3,259,976; Chemical and Pharmaceutical Bulletin (Tokyo) [26], 314(1978); Berichet der Deutschen Chemischen Gesellsdraft [82], 121(1948); U.S. Pat. Nos. 2,843,491; 3,017,270; British Patent No. 940,169 and Journal of American Chemical Society [44], 1502–1510.

It is specially noted that the use of the above-mentioned heterocyclic mercapto compound in a photo-sensitive material comprising a photo-sensitive silver halide emulsion containing silver halide grains which consist essentially of silver chloride in combination with the sensitizing dye of formula [I] has an advantage that occurrence of fog can be restrained effectively even in the case where the possibility of contamination of a bleach-fixing solution with a color developer solution carried in from a previous step is increased and the pH value thereof tends to increase when a photo-sensitive material undergoes bleach-fixing process immediately after color development process.

Among those exemplified hereinabove, the use of mercapto terazole compounds such as (IV-14) thru (IV-21) are especially preferable.

These nitrogen-containing heterocyclic mercapto compounds may be added to either the color developer or the sensitive material but it is preferable to add them to the sensitive material. In the event that they are added to the color developer, they are added at a ratio of $10^{-6}$ to $10^{-4}$ mol based on 1 liter of the color developer.

The nitrogen-containing heterocyclic mercapto compounds according to the present invention can be added to a sensitive silver halide emulsion layer or a non-sensitive constituent layer of photography but it is preferable to add the nitrogen-containing heterocyclic compound to the sensitive silver halide emulsion layer.

Two or more kinds of nitrogen-containing heterocyclic mercapto compound according to the present invention may be added and the nitrogen-containing heterocyclic mercapto compounds according to the present invention may be added to two or more different layers. These nitrogen-containing heterocyclic mercapto compounds are used at a ratio of $10^{-8}$ to $10^{-4}$ mol/m$^2$, preferably $10^{-7}$ to $10^{-5}$ mol/m$^2$.

Furthermore, the nitrogen-containing heterocyclic mercapto compounds according to the present invention may be added in the form of alkaline metal salts such as a sodium salt, a potassium salt and a lithium salt.

The fog-preventing effect by the combination of said sensitizing dye expressed by the general formula [I] with said nitrogen-containing heterocyclic mercapto compounds in a method of forming a dye image according to the present invention can reduce not only fog of a silver halide emulsion layer containing silver halide particles spectrally sensitized with said sensitizing dye but also that of other silver halide emulsion layers. This cannot be easily anticipated from the prior art.

The silver halide particles used in the present invention are formed of silver chloride, silver bromide, silver iodide, silver chloro-bromide, silver iodo-bromide, silver chloro-iodide and the like, preferably silver chloro-bromide, and in particular preferably silver chloro-bromide containing silver chloride at a ratio of 10% or more by mol.

An average particle diameter of said single dispersive silver halide particles are not especially limited but it should be 1.0 μm or less, preferably 0.8 μm or less.

In addition, the silver halide particles used in the present invention may have regular shapes, such as cubic shape and octahedral shape, and irregular shapes such as sharp shapes.

The silver halide emulsion of the sensitive silver halide emulsion layer according to the present invention may be doped with platinum, palladium, iridium, rhodium, ruthenium, bismuth, cadmium, copper or the like.

Furthermore, this silver halide emulsion can be chemically sensitized. Concretely speaking, it can be sensitized by sulfur sensitizing agents, such as allylthiocarbamides, N, N-diphenyl thiourea, sodium thiosulfate and cystine, noble metal sensitizing agents, such as gold compounds, palladium compounds, platinum compounds, ruthenium compounds, rhodium compounds and iridium compounds, or the combinations thereof. Also, it can be sensitized by reducing agents such as stannous chloride.

The binder used in the constituent layer of the silver halide photo-sensitive material according to the present invention is most generally formed of gelatine such as alkali-treated gelatine or acid-treated gelatine. Also, a part of this gelatine can be used together with gelatine derivatives, such as phthalized gelatine and phenylcarbamoylgelatine, albumin, agar-agar, Arabian rubber, alginic acid, partially hydrolyzed cellulose derivatives, partially hydrolyzed polyvinyl acetate, polyacrylamide, polyvinylalcohol, polyvinylpyrolidone and copolymers of these vinyl compounds.

The silver halide photo-sensitive material according to the present invention is subjected to the color developing process after the imagewise exposure to form the dye image. Particularly useful color developing agents used in the color developer include N, N-diethyl-p-phenylene diamine hydrochloride, N-methyl-p-phenylene diamine hydrochloride, N, N-dimethyl-o-phenylene diamine hydrochloride, 2-amino-5-(N-ethyl-N-dodecylamino)-toluene, N-ethyl-N-β-methane sulfonamide ethyl-3-methyl-4-aminoanilin sulfate, N-ethyl-N-β-hydroxylenthylaminoanilin sulfate, 4-amino-3-methyl-N, N-diethylaniline hydrochloride, N-ethyl-N-β-hydroxylethyl-3-methyl-4-aminoaniline sulfate, N-ethyl-N-methoxyethyl-3-methyl-4-aniline-p-toluene sulfonate and the like.

These color developing agents can be used singly or in the form of mixtures of two or more kinds thereof. In addition, the concentration of the color developing agents can be suitably selected within a range of 0.01 to 0.05 mol based on 1 liter of the color developer.

The color developer according to the present invention can comprise various kinds of additive for use in the development of photogrpahy in addition to said color developing agent and said hydroxylamine derivative as the preservative. For example, alkali agents such as sodium hydroxide, potassium hydroxide, sodium carbonate, potassium carbonate, sodium meta-borate and tertiary potassium phosfate, pH-buffer agents such as sodium hydrogen phosfate, potassium bihydrogen phosfate, bisodium hydrogen phosfate and potassium bicarbonate, organic solvents such as methanol and ethylene glycol triethanol amine and the like can be suitable selected and used. It is preferable that benzyl alcohol as the coloring capacity-improving agent is not contained in the color developer according to the present invention. However, it can be contained in a slight amount.

Benzyl alcohol is contained in the color developer at a ratio of 0 to 5 ml, preferably 0 to 3 ml, per 1 liter of the color developer.

It is particularly preferable in view of an increase of the preservative capacity of the color developer that the color developer according to the present invention comprises a small amount of sulfites, such as sodium sulfite and potassium sulfite, in combination in addition to said hydroxylamine derivative. The sulfites are used at a ratio of 0.05 to 2 g, preferably 0.1 to 0.3 g, per 1 liter of the color developer.

The color developer according to the present invention can comprise known development-inhibitors. Such development-inhibitors include bromides, such as sodium bromide and potassium bromide, chlorides, such as potassium chloride and sodium chloride, and organic development-inhibitors, such as benztriazole and benzimidazole.

The effects of the present invention is remarkable in the case where the concentration of the color developer according to the present invention is about 0.005 mol or more. In particular, in the case where the concentration of the color developer is 0.01 mol or more, the effect of the present invention, that is to say the effect of inhibiting the generation of fog due to the speedy processing in the event that hydroxylamine derivative is used, is remarkably increased. Here, the speedy processing means a processing in which the color development processing time is 90 seconds or less. The temperature of the color developer is set at 20° to 50° C., preferably 30° to 40° C.

In the speedy processing method according to the present invention it is required to remove an undeveloped silver halide and a developed image silver by the bleach-fixing process after the formation of the coloring matter image by the color development.

The bleach-fixing time is set at 90 seconds or less, preferably 60 seconds or less.

The bleach used in the bleach-fixing solution includes metal complexes of organic acids in which metallic ions, such as iron ions, cobalt ions and copper ions, are coordinated in organic acids such as polycarboxylic acids, polyaminocarboxylic acids, oxalic acid and citric acid. The most preferable organic acids of said organic acids are polycarboxylic acids and polyaminocarboxylic acids. These polycarboxylic acids may be used also in the form of alkali metal salt, ammonium salt or water soluble amine salt. Concrete examples of these include the following compounds:

(1) ethylene diamine tetraacetic acid
(2) diethylene triamine pentaacetic acid
(3) ethylenediamine-N-(β-oxyethyl)-N, N', N'-triacetic acid
(4) propylene diamine tetraacetic acid
(5) nitrilotriacetic acid
(6) cyclohexane diamine tetraacetic acid
(7) iminodiacetic acid
(8) dihydroxyethylglycin citric acid (or tartaric acid)
(9) ethyletherdiamine tetraacetic acid
(10) glycoletherdiamine tetraacetic acid
(11) ethylene diamine tetrapropyonic acid
(12) phenylene diamine tetraacetic acid
(13) ethylene diamine tetraacetic acid disodium salt
(14) ethylene diamine tetraacetic acid tetra (trimethylammonium) salt
(15) ethylene diamine tetraacetic acid tetrasodium salt
(16) diethylene triamine pentaacetic acid pentasodium salt
(17) ethylenediamine-N-(β-oxyethyl)-N, N', N'-triacetic acid sodium salt
(18) propylene diamine tetraacetic acid sodium salt
(19) nitriloacetic acid sodium salt
(20) cyclohexane diamine tetraacetic acid sodium salt These bleaches are used at a ratio of 5 to 450 g/liter, preferably 20 to 250 g/liter.

The bleach-fixing solution may comprise sulfites as preservatives in addition to said bleaches if necessary. In addition, the bleach-fixing solution may comprise an ethylene diamine tetraacetic acid iron (III) complex salt bleach and halides such as ammonium bromide.

Said halides include hydrochloric acid, hydrobromic acid, lithium bromide, sodium bromide, potassium bromide, sodium iodide, potassium iodide, ammonium iodide and the like in addition to ammonium bromide.

The silver halide-fixing agents used in the bleach-fixing solution include compounds, which react upon silver halide to form water soluble complex salts, used in the usual fixing process, typically thiosulfates, such as potassium thiosulfate, sodium thiosulfate and ammonium thiosulfate, thiocyanates, such as potassium thiocyanate, sodium thiocyanate and ammonium thiocyanate, thiourea, thioether and the like. These fixing agents are used at a ratio of 5 g/liter or more but in a quantity within a range in which they can be dissolved, in general at a ratio of 25 to 250 g/liter.

In addition, the bleach-fixing solution can comprise various kinds of pH-buffer agent, such as boric acid, borax, sodium hydroxide, potassium hydroxide, sodium carbonate, potassium carbonate, sodium bicarbonate, potassium bicarbonate, acetic acid, sodium acetate and ammonium hydroxide, singly or in combination. Furthermore, the bleach-fixing solution can comprise various kinds of fluorescent whitening agent, anti-foamant or surfactant. Besides, the bleach-fixing solution can bisulfite-addition products of hydroxylamine, hydrazine and aldehyde compounds, preservatives such as N, N-dialkyl-hydroxylamine, organic chelating agents such as polyaminocarboxylic acids, stabilizers such as nitroalcohol and nitrates, organic solvents such as methanol, dimethylsulfoamide and dimethylsulfoxide and the like according to circumstances.

The bleach-fixing solution can comprise various kinds of bleach-accelerator disclosed in Japanese Patent Unexamined Publication No. 280/1971, Japanese Patent Examined Publication No. 8506/1970, Japanese Patent Examined Publication No. 556/1971, Belgian Patent No. 770,910, Japanese Patent Examined Publication No. 8836/1970, Japanese Patent Examined Publication No. 9854/1978, Japanese Patent Unexamined Publication No. 71634/1979, Japanese Patent Unexamined Publication No. 42349/1974 and the like.

The pH of the bleach-fixing solution is set at 5.0 to 9.0, preferably 5.5 to 8.5.

Various kinds of process, such as color development and bleach-fixation (or bleaching and fixation), and furthermore washing, stabilization and drying carried out in case of need, of the silver halide color photo-sensitive material according to the present invention are carried out at temperatures of 25° C. or more, preferably 30° C. or more, in view of the speed-up of the processes.

The silver halide photo-sensitive material according to the present invention may be subjected to washing-substitute stabilizing treatments disclosed in Japanese Patent Unexamined Publication No. 14834/1983, Japanese Patent Unexamined Publication No. 105145/1983, Japanese Patent Unexamined Publication No. 134634/1983, Japanese Patent Unexamined Publication No. 18631/1983, Japanese Patent Application No. 2709/1983, Japanese Patent Application No. 89288/1984 and the like.

The preferred embodiments of the present invention are below described but they are not restrictive.

EXAMPLE 1

The following layers were coated in turn on a titanium dioxide-contained polyethylene side of a support member obtained by laminating polyethylene on one side of a paper support member of 170 g/m$^2$ and laminating polyethylene containing anatase type titanium dioxide at a ratio of 11% by weight on the other side of the paper support member to form silver halide color photo-sensitive materials No. 1 to 25.

The addition quantity was expressed in a quantity per 1 m$^2$ so far as it was not specially mentioned otherwise.

The layer 1 - - - comprising 1.9 g of gelatin, 0.39 g of (based on silver) blue light-sensitive silver chloro-bromide emulsion (Note-1), 1.2×10 mol of a yellow coupler expressed by Y-1, the following photo-stabilizer STB-1 of 0.3 g, 0.05 g of the following color contamination-inhibitor (HQ-1), 0.50 g of di-(2-ethylhexyl) phthalate (hereinafter referred to as DOP) and mercapto compounds as shown in Table 1 (0.08 g/m$^2$).

The layer 2 - - - an intermediate layer comprising 0.7 g of gelatine, 15 mg of an irradiation-inhibiting dye (AI-1) and 0.05 g of DOP, in which 10 mg of (AI-2) and 0.05 g of said color contamination-inhibitor HQ-1 are dissolved.

The layer 3 - - - comprising 1.25 g of gelatine, 0.22 g of green light-sensitive silver chloro-bromide emulsion (containing silver chloride at a ratio of 70% by mol), 0.30 g of DOP, in which 0.45 g of the following magenta coupler (M-1) is dissolved, and 0.02 g of HQ-1.

The layer 4 - - - comprising 1.2 g of gelatine, 0.08 g of HQ-11 and 0.35 g of DOP, in which 0.5 of ultraviolet absorbent (UV-1) is dissolved.

The layer 5 - - - comprising 1.4 g of gelatine, 0.20 g of red light-sensitive silver chloride emulsion, 0.20 g of DOP, in which 0.45 g of the following cyan coupler (C-1) is dissolved, and 0.02 g of HQ-1.

The layer 6 - - - comprising 1.0 g of gelatine and 0.20 g of DOP, in which 0.30 g of UV-1 is dissolved.

The layer 7 - - - comprising 0.5 g of gelatine.

In addition, 0.4 g of 2, 4-dichloro-6-hydroxy-s-triazine sodium as the film-setting agent was added to said layer 4 and said layer 7, respectively, immediately before the application thereof.

(Note 1) Blue light-sensitive silver chloro-bromide emulsion.

Silver chloro-bromide emulsion containing silver chloride at a ratio of 90% by mol was chemically ripened until the optimum sensitivity point to sodium thiosulfate and then spectrally sensitized by the use of sensitizing dyes as shown in Table 1 (at a ratio of $5\times10^{-3}$ mol per 1 mol of silver halide).

Formulae (Y-1) to UV-1

Each of said sensitive materials No. 1 to No. 25 was exposed to a white light through an optical wedge and then subjected to the following processes:

| (Process) | (A) | (B), (C) |
|---|---|---|
| Color development | 38° C., 3 min | 35° C., 1 min |
| Bleach-fixation | 34° C., 1 min | 35° C., 1 min |
| Washing | 30 to 35° C., 2 min | 30 to 35° C., 1 min |

The compositions of the color developer and the bleach-fixing solution are as follows:

| [Composition of the color developer] | [A] | [B], [C] |
|---|---|---|
| Pure water | 800 ml | 800 ml |
| Ethylene glycol | 15 ml | — |
| Benzyl alcohol | 15 ml | — |
| Preservative*1 | 2 g | 2 g |
| Potassium bromide | 1.2 g | — |
| Sodium chloride | 0.3 g | 2.0 g |
| Potassium sulfite | 2.0 g | 0.1 g |
| Color developing agent | 4.5 g | 5 g |
| Potassium carbonate | 25 g | 25 g |
| Nitrilotrimethylene sulfonic acid | 2 g | 2 g |
| After adding pure water to 1 liter pH is adjusted | 10.1 | 10.2 |

*1Preservatives
A, B Sulfuric acid hydroxylamine ½ sulfate (HAS)
C N, N-diethylhydroxylamine (HA)

| [Composition of the bleach-fixing solution] | |
|---|---|
| Pure water | 600 ml |
| Ethylene diamine tetraacetic acid ion (III) ammonium | 65 g |
| Ethylene diamine tetraacetic disodium salt | 5 g |
| Ammonium thiosulfate | 85 g |
| Sodium hydrogen sulfite | 10 g |
| Sodium metabisulfite | 2 g |
| Ethylene diamine tetraacetic acid sodium | 20 g |
| Sodium chloride | 10 g |
| Color developer | 200 ml |

After adding pure water to 1 liter pH is adjusted to 7.0 with diluted sulfuric acid.

The reflective concentration of a blue monochromatic light was measured for each of the resulting samples. The sensitivity was measured from the characteristic curve [B] corresponding to the yellow dye image. The gradation and fog were measured. As regards fog, it was also measured by the use of green monochromatic light.

The obtained results are shown in Table 1.

TABLE 1

| Sample No. | Sensitizing dye | Heterocyclic mercapto compound | Developer [A] Sensitivity B | [A] Gradation B | [A] Fog B | [A] Fog G | [B] Sensitivity B | [B] Gradation B | [B] Fog B | [B] Fog G |
|---|---|---|---|---|---|---|---|---|---|---|
| 1 | — | — | — | — | 0.04 | 0.06 | — | — | 0.05 | 0.05 |
| 2 | — | (Comparative compound-2) | — | — | 0.04 | 0.06 | — | — | 0.05 | 0.05 |
| 3 | — | (III-24) | — | — | 0.03 | 0.05 | — | — | 0.04 | 0.05 |
| 4 | — | (III-40) | — | — | 0.03 | 0.06 | — | — | 0.04 | 0.05 |
| 5 | — | (III-46) | — | — | 0.03 | 0.06 | — | — | 0.04 | 0.06 |
| 6 | (Comparative sensitizing dye 1) | — | 100 | 3.4 | 0.04 | 0.06 | 72 | 1.7 | 0.04 | 0.05 |
| 7 | (Comparative sensitizing dye 1) | (Reference compound 2) | 96 | 3.5 | 0.04 | 0.05 | 69 | 1.5 | 0.04 | 0.05 |
| 8 | (Comparative sensitizing dye 1) | [III]-24 | 97 | 3.4 | 0.03 | 0.04 | 70 | 1.2 | 0.03 | 0.04 |
| 9 | (Comparative sensitizing dye 1) | [III]-40 | 93 | 3.6 | 0.03 | 0.06 | 66 | 1.3 | 0.03 | 0.05 |
| 10 | (Comparative sensitizing dye 1) | [III]-46 | 94 | 3.5 | 0.03 | 0.05 | 68 | 1.3 | 0.04 | 0.06 |
| 11 | [I]-3 | — | 120 | 3.5 | 0.04 | 0.06 | 87 | 1.8 | 0.03 | 0.06 |
| 12 | [I]-3 | (Reference compound 2) | 117 | 3.6 | 0.04 | 0.06 | 84 | 1.6 | 0.03 | 0.05 |
| 13 | [I]-3 | [III]-24 | 117 | 3.5 | 0.03 | 0.04 | 85 | 1.2 | 0.02 | 0.04 |
| 14 | [I]-3 | [III]-40 | 112 | 3.5 | 0.02 | 0.06 | 82 | 1.1 | 0.02 | 0.06 |
| 15 | [I]-3 | [III]-46 | 114 | 3.5 | 0.02 | 0.06 | 82 | 1.2 | 0.03 | 0.05 |
| 16 | [I]-7 | — | 108 | 3.4 | 0.05 | 0.06 | 81 | 1.6 | 0.03 | 0.06 |
| 17 | [I]-7 | (Reference compound 2) | 103 | 3.5 | 0.03 | 0.06 | 77 | 1.4 | 0.03 | 0.05 |
| 18 | [I]-7 | [III]-24 | 102 | 3.5 | 0.03 | 0.05 | 79 | 1.1 | 0.02 | 0.05 |
| 19 | [I]-7 | [III]-40 | 96 | 3.7 | 0.03 | 0.05 | 73 | 1.2 | 0.02 | 0.06 |
| 20 | [I]-7 | [III]-46 | 99 | 3.6 | 0.03 | 0.06 | 75 | 1.3 | 0.02 | 0.05 |
| 21 | [I]-21 | — | 102 | 3.7 | 0.04 | 0.07 | 75 | 1.5 | 0.05 | 0.06 |
| 22 | [I]-21 | (Reference compound 2) | 99 | 3.9 | 0.04 | 0.08 | 73 | 1.3 | 0.04 | 0.05 |
| 23 | [I]-21 | [III]-24 | 97 | 3.9 | 0.02 | 0.06 | 74 | 1.3 | 0.03 | 0.05 |
| 24 | [I]-21 | [III]-40 | 90 | 3.6 | 0.04 | 0.07 | 68 | 1.2 | 0.04 | 0.05 |
| 25 | [I]-21 | [III]-46 | 89 | 3.7 | 0.03 | 0.06 | 65 | 1.4 | 0.04 | 0.06 |

| Sample No. | Sensitizing dye | Heterocyclic mercapto compound | Developer [C] Sensitivity B | [C] Gradation B | [C] Fog B | [C] Fog G |
|---|---|---|---|---|---|---|
| 1 | — | — | — | — | 0.11 | 0.09 |
| 2 | — | (Comparative compound-2) | — | — | 0.11 | 0.09 |
| 3 | — | (III-24) | — | — | 0.10 | 0.10 |
| 4 | — | (III-40) | — | — | 0.09 | 0.10 |
| 5 | — | (III-46) | — | — | 0.09 | 0.10 |
| 6 | (Comparative sensitizing dye 1) | — | 93 | 3.2 | 0.10 | 0.09 |
| 7 | (Comparative sensitizing dye 1) | (Reference compound 2) | 89 | 3.2 | 0.11 | 0.09 |
| 8 | (Comparative sensitizing dye 1) | [III]-24 | 89 | 3.3 | 0.08 | 0.09 |
| 9 | (Comparative sensitizing dye 1) | [III]-40 | 86 | 3.1 | 0.08 | 0.10 |
| 10 | (Comparative sensitizing dye 1) | [III]-46 | 88 | 3.2 | 0.09 | 0.09 |
| 11 | [I]-3 | — | 111 | 3.3 | 0.11 | 0.09 |
| 12 | [I]-3 | (Reference compound 2) | 109 | 3.2 | 0.08 | 0.08 |
| 13 | [I]-3 | [III]-24 | 108 | 3.4 | 0.04 | 0.06 |
| 14 | [I]-3 | [III]-40 | 105 | 3.5 | 0.05 | 0.06 |
| 15 | [I]-3 | [III]-46 | 105 | 3.3 | 0.05 | 0.06 |
| 16 | [I]-7 | — | 101 | 3.1 | 0.09 | 0.09 |
| 17 | [I]-7 | (Reference compound 2) | 96 | 3.2 | 0.07 | 0.07 |
| 18 | [I]-7 | [III]-24 | 100 | 3.2 | 0.03 | 0.05 |
| 19 | [I]-7 | [III]-40 | 93 | 3.2 | 0.05 | 0.05 |
| 20 | [I]-7 | [III]-46 | 95 | 3.2 | 0.04 | 0.05 |
| 21 | [I]-21 | — | 91 | 3.4 | 0.14 | 0.08 |
| 22 | [I]-21 | (Reference compound 2) | 90 | 3.5 | 0.12 | 0.07 |
| 23 | [I]-21 | [III]-24 | 87 | 3.3 | 0.06 | 0.06 |
| 24 | [I]-21 | [III]-40 | 86 | 3.2 | 0.08 | 0.06 |

TABLE 1-continued

| | | | | | | |
|---|---|---|---|---|---|---|
| 25 | [I]-21 | [III]-46 | 84 | 3.1 | 0.07 | 0.06 |

Comparative sensitizing dye-1

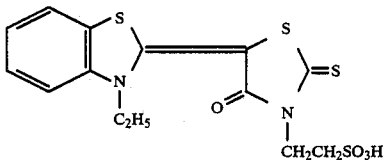

Comparative compound-2

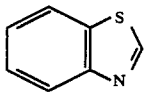

The sensitivity was expressed by a relative sensitivity with the sensitivity obtained in the event that the sensitive material 1 was processed in accordance with the process [A] as 100. In addition, the gradation is expressed by an inclination of the characteristic curve having a reflective density of 0.5 to 1.5.

It is found from the results shown in Table 1 that with the color developer [B] using hydroxylamine as the preservative, the color density is reduced, the sensitivity being reduced and the gradation being softened regardless of the kind of sensitizing dyes and the existence of heterocyclic mercapto compounds, and on the contrary, with the color developer [C] using N, N-diethylhydroxylamine as the preservative, the sensitivity is reduced and the softening of the gradation are not observed but the fog is increased.

It is found that both samples which do not contain a sensitizing dye (No. 1 to No. 5) and the samples containing the emulsion sensitized by the comparative sensitizing dye-1 (No. 6 to No. 10) exhibit an only slight effect of preventing fog by the heterocyclic mercapto compounds while the samples (No. 11 to No. 25) containing the emulsion sensitized by the sensitizing dyes [I]-7, [I]-11 and [I]-26, in particular containing the heterocyclic mercapto compounds [III]-24, [III]-40 and [III]-46 exhibit a remarkable effect of preventing fog, and furthermore, effectively prevent not only the yellow fog generated in the blue light-sensitive layer but also the magenta fog generated in the green light-sensitive layer.

EXAMPLE-2

The processes were carried out in the same manner as in EXAMPLE 1 excepting that the spectral sensitizing dyes used for the blue light-sensitive silver chloro-bromide emulsion used in the layer 1 were changed as shown in Table 2 ($5\times10^{-3}$ mol per 1 mol of silver halide and mercapto compounds were added to the layer 1 and the layer 3 as shown in Table 2.

The obtained samples No. 26 to No. 38 were processed in the same manner as in EXAMPLE 1 with the results as shown in Table 2.

Table 2 shows the results obtained in the cases where the samples obtained by adding the mercapto compound [III]-24, which exhibited the best effect of preventing fog in EXAMPLE 1, to the layers containing the blue light-sensitive silver chloro-bromide emulsion sensitized by the comparative sensitizing dye and the sensitizing dyes [I]-3, [I]-7 and [I]-21 and the samples obtained by adding said mercapto compound [III]-19 to the layers containing the green light-sensitive emulsion were processed with the color developers [A], [B] and [C] used in EXAMPLE 1. It is found from Table 2 that the former samples exhibit a great effect of preventing fog by using the sensitizing dye [I] together with the heterocyclic mercapto compounds [III] when processed with the color developer [C] in the same manner as in EXAMPLE 1 and furthermore a remarkable effect of preventing the yellow fog in the case whre the heterocyclic mercapto compounds are added to the layer 3 which is the green light-sensitive emulsion layer.

In addition, it is found that also the samples obtained by dividedly adding the heterocyclic mercapto compounds to the layer 1 and the layer 3 (the blue light-sensitive layer and the green light-sensitive layer) exhibit a great effect of preventing yellow fog and magenta fog when processed with the color developer [C].

EXAMPLE 3

The samples No. 26, No. 27, No. 35 and No. 36 used in EXAMPLE 2 were subjected to the imagewise exposure and then processed in the same manner as in the processes [B], [C].

However, in this EXAMPLE the pH of the color developers [B], [C] used in the processes [B], [C] was changed to 9.7, 10.1 and 10.5, respectively. The harmony (the inclination at the reflective concentration of 0.5 to 1.5) was determined from the characteristic curves obtianed by the measurement of the reflective concentration of the obtained samples by the use of a blue monochromatic light. The results are shown in Table 3.

It is found from the results shown in Table 3 that the samples sensitized by the comparative sensitizing dye exhibit considerable changes in the gradation with the change of the color developer in pH due to the addition of the heterocyclic mercapto compounds. The fluctuating range of harmony has a tendency of increasing in the case [C] where N, N-diethylhydroxylamine is used as the preservative of the color developer. On the contrary, the sample No. 36 according to the present invention exhibits a slight fluctuation in the gradation with a change of pH.

TABLE 2

| Sample No. | Sensitizing dye | Heterocyclic mercapto compound | Layer added | [A] Sensitivity B | [A] Gradation B | [A] Fog B G | [B] Sensitivity B | [B] Gradation B | [B] Fog B G | [C] Sensitivity B | [C] Gradation B | [C] Fog B G |
|---|---|---|---|---|---|---|---|---|---|---|---|---|
| 26 | Comparative sensitizing dye-1 | — | | 100 | 3.4 | 0.04 0.06 | 72 | 1.7 | 0.04 0.05 | 93 | 3.2 | 0.10 0.09 |
| 27 | Comparative sensitizing dye-1 | [III]-24 | Layer 1 | 97 | 3.4 | 0.03 0.04 | 70 | 1.2 | 0.03 0.04 | 89 | 3.3 | 0.08 0.09 |
| 28 | Comparative sensitizing dye-1 | [III]-24 | Layer 3 | 99 | 3.4 | 0.04 0.04 | 70 | 1.6 | 0.04 0.03 | 92 | 3.2 | 0.10 0.07 |
| 29 | [I]-3 | — | | 120 | 3.5 | 0.04 0.06 | 87 | 1.8 | 0.03 0.06 | 111 | 3.3 | 0.11 0.09 |
| 30 | [I]-3 | [III]-24 | Layer 1 | 117 | 3.5 | 0.03 0.04 | 85 | 1.2 | 0.02 0.04 | 108 | 3.4 | 0.04 0.06 |
| 31 | [I]-3 | [III]-24 | Layer 3 | 118 | 3.5 | 0.03 0.03 | 87 | 1.4 | 0.03 0.04 | 111 | 3.5 | 0.06 0.04 |
| 32 | [I]-7 | — | | 108 | 3.4 | 0.05 0.06 | 81 | 1.6 | 0.03 0.06 | 101 | 3.1 | 0.09 0.09 |
| 33 | [I]-7 | [III]-24 | Layer 1 | 102 | 3.5 | 0.03 0.05 | 79 | 1.1 | 0.02 0.05 | 100 | 3.2 | 0.03 0.05 |
| 34 | [I]-7 | [III]-24 | Layer 3 | 107 | 3.5 | 0.05 0.04 | 80 | 1.5 | 0.03 0.03 | 100 | 3.2 | 0.04 0.03 |
| 35 | [I]-21 | — | | 102 | 3.7 | 0.04 0.07 | 75 | 1.5 | 0.05 0.06 | 91 | 3.4 | 0.14 0.08 |
| 36 | [I]-21 | [III]-24 | Layer 1 | 97 | 3.9 | 0.02 0.06 | 74 | 1.3 | 0.03 0.05 | 87 | 3.3 | 0.06 0.06 |
| 37 | [I]-21 | [III]-24 | Layer 3 | 100 | 3.8 | 0.04 0.04 | 76 | 1.6 | 0.05 0.04 | 90 | 3.2 | 0.07 0.04 |
| 38 | [I]-21 | [III]-24 | Layer 1 + Layer 3 | 98 | 3.9 | 0.03 0.05 | 73 | 1.7 | 0.03 0.04 | 87 | 3.1 | 0.06 0.04 |

(Note) The mercapto compound was added to the layer 1 and the layer 3 with respect to samples No. 38 in a quantity ½ times as much as that added to layer 1 and the layer 3 of samples No. 27, No. 28.

EXAMPLE 4

On the reflective support used in EXAMPLE 1 following layers were provided in order from the support to prepare silver halide color photo-sensitive materials No. 39 to 62.

Layer 1 - - - A layer comprising 1.4 g of gelatin, 0.3 g of blue light-sensitive silver chloro-bromide emulsion(Note 2), $1.1\times10^{-3}$ mol of yellow coupler(Y-2), 0.3 g of STB-1, 0.05 g of HQ-1 and 0.5 g of di-nonylphthalate of in which 0.1 g of N,N-diethyl-(2,5-di-t-amylphenoxy) acetamide is dissolved.

Layer 2 - - - Same as Layer 2 of EXAMPLE 1.

Layer 3 - - - A layer comprisinq 1.259 of gelatin, O.3 g of green light-sensitive silver chloro-bromide emulsion(Note 3), 0.4 g of magenta coupler(M-1) dissolved in 0.3 g of DOP, 0.2 g of STB-2, 0.1 g of STB-3, and 0.02 g of HQ-1.

Layer 4 - - - Same as Layer 4 of EXAMPLE 1.

Layer 5 - - - A layer comprising 1.4 g of gelatin, O.20 g of red light-sensitive silver chloro-bromide emulsion (Note 4), 0.45 g of cyan coupler(C-1) dissolved in 0.2 g of DOP, 0.10 g of STB-1 and 0.025 g of HQ-1 and 0.5 g of di-nonylphthalate is dissolved.

Layer 6 - - - Same as Layer 6 of EXAMPLE 1.

Layer 7 - - - Same as Layer 7 of EXAMPLE 1.

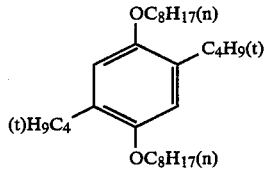

(STB-2)

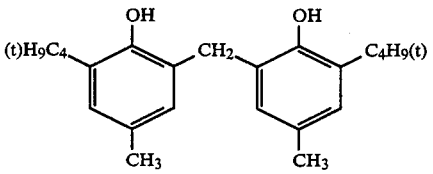

(STB-3)

(Note-2) Blue light-sensitive silver chlorobromide emulsion: Silver chlorobromide emulsion containing cubic silver chorobromide crystals, said silver chlorobromide containing silver chloride at a ratio of 99.5% by mol and having an average grain size of 0.70 μm, was chemically ripened by the use of sodium thiosulfate and potassium choloroaurate to an optimum sensitivity point. Thereafter, $5\times10^{-3}$ mol per 1 mol of silver halide of a sensitizing dye given in Table 4 and $2\times10^{-4}$ mol per 1mol of silver halide of the mercapto compound given in Table 4 were added to the emulsion.

(Note-3) Green light-sensitive silver chlorobromide emulsion:

Silver chorobromide emulsion containing cubic silver chlorobromide crystals, said silver chlorobromide containing silver chloride at a ratio of 99.1% by mol and having an average grain size of 0.40 μm, was chemically ripened by the use of sodium thiosulfate and potassium choloroaurate to an optimum sensitivity point. Thereafter, $3\times10^{-3}$ mol per 1 mol of silver halide of a sensitizing dye (GSD-1) given hereinbelow and $2.5\times10^{-4}$ mol per 1mol of silver halide of the mercapto compound given in Table 4 were added to the emulsion.

(Note-4) Red light-sensitive silver chlorobromide emulsion:

Silver chlorobromide emulsion containing cubic silver chlorobromide crystals, said silver chlorobromide containing silver chloride at a ratio of 99.6% by mol and having an average grain size of 0.42 μm, was chemically ripened by the use of sodium thiosulfate and potassium choloroaurate to an optimum sensitivity point. Thereafter, $0.8\times10^{-4}$ mol per 1 mol of silver halide of a sensitizing dye (RSD-1) given hereinbelow and $2.5\times10^{-4}$ mol per 1 mol of silver halide of the mercapto compound given in Table 4 were added to the emulsion.

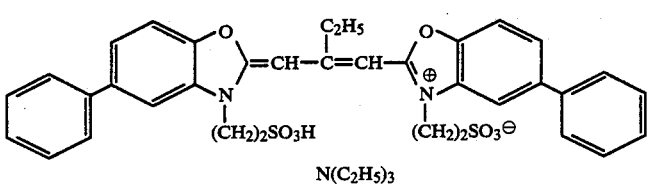

GSD-1

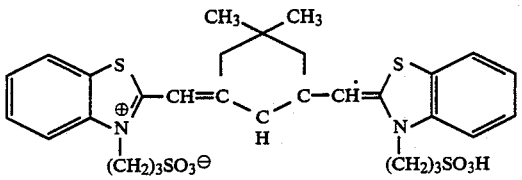

RSD-1

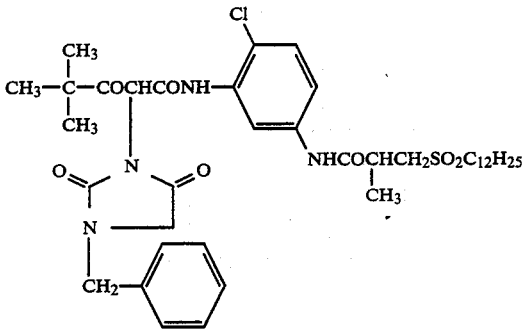

Y-2

The photo-sensitive materials thus obtained were subjected to white exposure through an optical wedge and, thereafter, to the following processes:

| (Process) | [D], [E], [F] and [G] | |
|---|---|---|
| Color Development | 35° C. | 45 sec. |
| Bleach-Fixing | 35° C. | 45 sec. |
| Washing | 30~34° C. | 2 min. |

The compositions used of the color developera with respect to the processes are as follows:

| [Composition] | [Process] [D] and [E] | [F] and [G] |
|---|---|---|
| Pure Water | 800 ml | 800 ml |
| Triethanol amine | 10 g | 10 g |
| Hydroxylamine sulfate | 1.8 g | — |
| N,N-diethylhydroxyl-amine([II]-3) | — | 5 g |
| | — | 5 g |
| Sodium chloride | 2.8 g | 2.8 g |
| Potassium sulfite | 0.3 g | 0.3 g |
| Color developing agent* | 4.5 g | 4.5 g |
| Ethylenediaminetetra-acetic acid | 1.0 g | 1.0 g |
| Potassium carbonate | 27 g | 27 g |
| Diaminostilbene type fluorescent brightening agent | 2 g | 2 g |

Add water to make the total volume of 1 liter and adjust pH at 10.0.

As bleach-fixing solution the followings were used with reference to the respective processes:

[D] and [F]

The same bleach-fixing solution as used in Example 1 was used except that this solution did not contain color developer and pH was adjusted to 6.2.

[E]

The bleach-fixing solution used for process [D] and the color developer used for [E] were mixed at a ratio of 1:1 pH thereof was adjusted to 7.0.

[G]

The bleach-fixing solution used for process [D] and the color developer used for [F] were mixed at a ratio of 1:1 and pH thereof was adjusted to 7.0.

The reflective density measurement of the respective samples were corried out and sensitivity, gradation and fog of the respective samples were obtained from the characteristic curves thereof.

The results are shown in Table 4. In the table sensivity is expessed in terms of a relative sensitivity when the sensitivity of Comparative Sample 39 with the process [F] is made 100.

TABLE 4

| Sample No. | Blue Sensitizing Dye | Mercapto Compound Layer-1 | Layer-3 | Layer-5 | Sensitivity D | E | F | G | Gradation D | E | F | G | Fog D | E | F | G |
|---|---|---|---|---|---|---|---|---|---|---|---|---|---|---|---|---|
| 39 | Comparative Dye 1 | Comparative Compound 2 | Comparative Compound 2 | Comparative Compound 2 | 60 | 58 | 100 | 102 | 1.6 | 1.6 | 3.2 | 3.2 | 0.06 | 0.09 | 0.09 | 0.13 |
| 40 | Comparative Dye 1 | Comparative Compound 3 | Comparative Compound 3 | Comparative Compound 3 | 42 | 41 | 82 | 80 | 1.4 | 1.5 | 3.1 | 3.1 | 0.05 | 0.08 | 0.10 | 0.12 |

TABLE 4-continued

| Sample No. | Blue Sensitizing Dye | Mercapto Compound Layer-1 | Layer-3 | Layer-5 | Sensitivity D | E | F | G | Gradation D | E | F | G | Fog D | E | F | G |
|---|---|---|---|---|---|---|---|---|---|---|---|---|---|---|---|---|
| 41 | Comparative Dye 1 | Comparative Compound 4 | Comparative Compound 4 | Comparative Compound 4 | 46 | 45 | 79 | 82 | 1.6 | 1.6 | 3.1 | 3.0 | 0.05 | 0.09 | 0.10 | 0.13 |
| 42 | Comparative Dye 1 | III-24 | III-24 | III-24 | 61 | 64 | 96 | 97 | 1.6 | 1.7 | 3.2 | 3.3 | 0.04 | 0.07 | 0.08 | 0.10 |
| 43 | Comparative Dye 1 | IV-14 | IV-14 | IV-14 | 64 | 63 | 109 | 110 | 1.7 | 1.7 | 3.3 | 3.3 | 0.04 | 0.07 | 0.07 | 0.11 |
| 44 | Comparative Dye 1 | IV-20 | IV-20 | IV-20 | 62 | 62 | 112 | 111 | 1.6 | 1.7 | 3.0 | 3.1 | 0.04 | 0.07 | 0.07 | 0.10 |
| 45 | I-8 | Comparative Compound 2 | Comparative Compound 2 | Comparative Compound 2 | 63 | 62 | 104 | 105 | 1.7 | 1.6 | 3.1 | 3.2 | 0.05 | 0.06 | 0.09 | 0.12 |
| 46 | I-8 | Comparative Compound 3 | Comparative Compound 3 | Comparative Compound 3 | 49 | 51 | 80 | 83 | 1.6 | 1.7 | 3.2 | 3.1 | 0.05 | 0.06 | 0.09 | 0.11 |
| 47 | I-8 | Comparative Compound 4 | Comparative Compound 4 | Comparative Compound 4 | 50 | 50 | 70 | 74 | 1.7 | 1.7 | 3.1 | 3.2 | 0.05 | 0.06 | 0.10 | 0.12 |
| 48 | I-8 | III-24 | III-24 | III-24 | 62 | 65 | 102 | 104 | 1.7 | 1.8 | 3.3 | 3.3 | 0.04 | 0.05 | 0.06 | 0.09 |
| 49 | I-8 | IV-14 | IV-14 | IV-14 | 60 | 59 | 123 | 126 | 1.6 | 1.7 | 3.1 | 3.1 | 0.04 | 0.04 | 0.06 | 0.07 |
| 50 | I-8 | IV-20 | IV-20 | IV-20 | 67 | 68 | 120 | 122 | 1.7 | 1.8 | 3.2 | 3.2 | 0.04 | 0.04 | 0.06 | 0.07 |
| 51 | I-18 | Comparative Compound 2 | Comparative Compound 2 | Comparative Compound 2 | 72 | 73 | 126 | 131 | 1.8 | 1.7 | 3.2 | 3.1 | 0.06 | 0.07 | 0.10 | 0.13 |
| 52 | I-18 | Comparative Compound 3 | Comparative Compound 3 | Comparative Compound 3 | 70 | 73 | 102 | 104 | 1.9 | 1.8 | 3.1 | 3.1 | 0.05 | 0.06 | 0.10 | 0.12 |
| 53 | I-18 | Comparative Compound 4 | Comparative Compound 4 | Comparative Compound 4 | 62 | 59 | 92 | 95 | 1.7 | 1.6 | 3.3 | 3.2 | 0.06 | 0.06 | 0.10 | 0.12 |
| 54 | I-18 | III-24 | III-24 | III-24 | 74 | 77 | 111 | 111 | 1.7 | 1.7 | 3.3 | 3.2 | 0.04 | 0.05 | 0.06 | 0.08 |
| 55 | I-18 | IV-14 | IV-14 | IV-14 | 79 | 78 | 132 | 133 | 1.8 | 1.6 | 3.2 | 3.1 | 0.04 | 0.04 | 0.05 | 0.05 |
| 56 | I-18 | IV-20 | IV-20 | IV-20 | 78 | 77 | 141 | 140 | 1.8 | 1.8 | 3.1 | 3.2 | 0.04 | 0.04 | 0.05 | 0.05 |
| 57 | I-21 | Comparative Compound 2 | Comparative Compound 2 | Comparative Compound 2 | 76 | 76 | 131 | 130 | 1.9 | 1.8 | 3.3 | 3.2 | 0.06 | 0.06 | 0.10 | 0.12 |
| 58 | I-21 | Comparative Compound 3 | Comparative Compound 3 | Comparative Compound 3 | 60 | 62 | 112 | 116 | 1.8 | 1.7 | 3.2 | 3.2 | 0.05 | 0.07 | 0.09 | 0.11 |
| 59 | I-21 | Comparative Compound 4 | Comparative Compound 4 | Comparative Compound 4 | 52 | 53 | 103 | 102 | 1.7 | 1.8 | 3.3 | 3.2 | 0.05 | 0.06 | 0.10 | 0.11 |
| 60 | I-21 | III-24 | III-24 | III-24 | 67 | 62 | 120 | 124 | 1.7 | 1.8 | 3.1 | 3.2 | 0.04 | 0.05 | 0.06 | 0.07 |
| 61 | I-21 | IV-14 | IV-14 | IV-14 | 71 | 70 | 139 | 142 | 1.8 | 1.8 | 3.2 | 3.1 | 0.04 | 0.05 | 0.05 | 0.05 |
| 62 | I-21 | IV-20 | IV-20 | IV-20 | 70 | 69 | 137 | 140 | 1.7 | 1.7 | 3.3 | 3.2 | 0.04 | 0.04 | 0.05 | 0.05 |

Comparative Compound 3

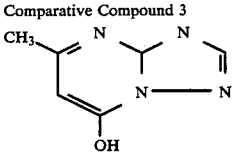

Comparative Compound 4

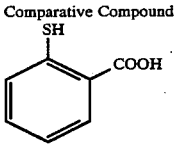

It is apparent from the results shown in Table 4 that fog can be restrained effectively in the samples, in which exemplified mercapto compounds III-24, IV-14 and IV-20 in combination with a blue dye sensitizer of the present invention are employed (Samples Nos. 48, 49, 50, 54, 55, 56, 60, 61 and 62), in respective cases when they are processed with either [D],[E], [F] or [G]. In comparison therewith, with respect to those samples, in which either one of sensitizing dye or mercapto compound outside the scope of the invention is used (Samples Nos. 39, 40, 41, 45, 46, 47, 51, 52, 53, 57, 58 and 59), although occurrence of fog is relatively low when these samples were processed with [D], increase in the fog was observed when N,N-diethylhydroxylamine was employed as the presevative (in process [F]) and this tendency was further amplified in process [G] due to contamination by color developer. In accordance with the present invention, occurrence of fog can be effectively restrained even in the process [G] and this effect was found to be remarkable when a mercapto tetrazole compound such as IV-14 or IV-20 is employed.

EXAMPLE 5

Samples 63 thru 86 were prepared respectively in the same manner as Samples 39 thru 62 in EXAMPLE 4, except that in the samples if the EXAMPLE a half amount of mercapto compound used in layer 1 of the respective samples in EXAMPLE 3 were further added to layer 2.

The samples thus prepared were processed in the same manner as in EXAMPLE 4, with the proviso that, in this EXAMPLE, 10 g per 1 liter of color developer of II-25 was used in place of II-3 as a preserver for the color developer.

The results are shown in Table 5.

It is apparent from the table that similar effect as obtained in EXAMPLE 4 can also be obtainable in the case where II-25 is employed as the preserver for the color developer.

TABLE 5

| Sample | Sensitivity | | | | Gradation | | | | Fog | | | |
|---|---|---|---|---|---|---|---|---|---|---|---|---|
| No. | D | E | F | G | D | E | F | G | D | E | F | G |
| 63 | 59 | 57 | 100 | 103 | 1.6 | 1.6 | 3.4 | 3.3 | 0.06 | 0.08 | 0.08 | 0.12 |
| 64 | 40 | 40 | 76 | 76 | 1.5 | 1.6 | 3.6 | 3.5 | 0.06 | 0.08 | 0.09 | 0.11 |
| 65 | 42 | 43 | 73 | 72 | 1.5 | 1.6 | 3.4 | 3.0 | 0.05 | 0.08 | 0.09 | 0.12 |
| 66 | 70 | 67 | 101 | 103 | 1.6 | 1.7 | 3.6 | 3.6 | 0.04 | 0.07 | 0.08 | 0.11 |
| 67 | 66 | 68 | 113 | 111 | 1.7 | 1.6 | 3.6 | 3.6 | 0.04 | 0.07 | 0.08 | 0.10 |
| 68 | 65 | 66 | 106 | 110 | 1.7 | 1.7 | 3.5 | 3.6 | 0.04 | 0.07 | 0.07 | 0.10 |
| 69 | 60 | 61 | 98 | 103 | 1.7 | 1.6 | 3.6 | 3.6 | 0.05 | 0.05 | 0.08 | 0.12 |
| 70 | 50 | 57 | 81 | 83 | 1.8 | 1.7 | 3.5 | 3.4 | 0.05 | 0.06 | 0.09 | 0.12 |
| 71 | 47 | 56 | 80 | 81 | 1.8 | 1.6 | 3.4 | 3.4 | 0.05 | 0.05 | 0.09 | 0.11 |
| 72 | 70 | 66 | 103 | 114 | 1.7 | 1.7 | 3.3 | 3.5 | 0.04 | 0.04 | 0.06 | 0.09 |
| 73 | 68 | 57 | 119 | 126 | 1.7 | 1.7 | 3.4 | 3.5 | 0.04 | 0.05 | 0.06 | 0.07 |
| 74 | 66 | 64 | 121 | 123 | 1.7 | 1.8 | 3.6 | 3.5 | 0.04 | 0.04 | 0.06 | 0.06 |
| 75 | 70 | 70 | 120 | 127 | 1.9 | 1.8 | 3.5 | 3.4 | 0.05 | 0.06 | 0.10 | 0.12 |
| 76 | 66 | 71 | 100 | 106 | 1.8 | 1.8 | 3.5 | 3.5 | 0.05 | 0.06 | 0.09 | 0.11 |
| 77 | 61 | 58 | 96 | 102 | 1.9 | 1.6 | 3.4 | 3.4 | 0.05 | 0.06 | 0.09 | 0.12 |
| 78 | 76 | 75 | 114 | 118 | 1.9 | 1.7 | 3.3 | 3.5 | 0.04 | 0.04 | 0.05 | 0.07 |
| 79 | 80 | 72 | 127 | 134 | 1.8 | 1.8 | 3.4 | 3.6 | 0.04 | 0.04 | 0.05 | 0.04 |
| 80 | 80 | 73 | 129 | 131 | 1.9 | 1.7 | 3.6 | 3.5 | 0.04 | 0.04 | 0.05 | 0.04 |
| 81 | 72 | 70 | 126 | 136 | 1.8 | 1.7 | 3.3 | 3.5 | 0.05 | 0.05 | 0.09 | 0.11 |
| 82 | 55 | 58 | 104 | 105 | 1.8 | 1.8 | 3.6 | 3.6 | 0.05 | 0.05 | 0.09 | 0.11 |
| 83 | 51 | 54 | 100 | 104 | 1.9 | 1.8 | 3.4 | 3.4 | 0.05 | 0.05 | 0.09 | 0.10 |
| 84 | 74 | 59 | 124 | 131 | 1.9 | 1.7 | 3.5 | 3.5 | 0.05 | 0.04 | 0.05 | 0.07 |
| 85 | 69 | 69 | 121 | 127 | 1.8 | 1.7 | 3.7 | 3.5 | 0.04 | 0.04 | 0.06 | 0.04 |
| 86 | 65 | 65 | 136 | 138 | 1.7 | 1.6 | 3.6 | 3.5 | 0.04 | 0.04 | 0.05 | 0.04 |

What is claimed is:

1. A method of processing light-sensitive silver halide photographic material which comprises processing an imagewise exposed color light-sensitive silver halide photographic material comprising a support and, provided thereon, at least one silver halide emulsion layer containing light-sensitive silver halide grains which are sensitized with a sensitizing dye of general Formula I

I

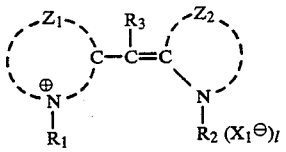

wherein $Z_1$ and $Z_2$ independently represent a group of atoms necessary to complete a heterocyclic ring consisting of a thiazole, a benzothiazole, a naphthothiazole, a selenazole, a benzoselenazole or a naphthoselenazole, wherein said heterocyclic ring may have a substituent; $R_1$ and $R_2$ are independently selected from a group consisting of alkyl, alkenyl, and aryl; $R_3$ is selected from a group consisting of hydrogen methyl and ethyl; $X_1$ is an anion and l is 0 or 1; with a color developer solution containing an aromatic primary amine color developing agent in the presence of at least one hydroxylamine derivative of general Formula II or a water soluble salt thereof;

II

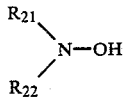

wherein $R_{21}$ and $R_{22}$ are independently an alkyl group having 1 to 4 carbon atoms which may have a substituent; and at least one nitrogen containing heterocyclic mercapto compound selected from mercaptotetrazole and compounds of Formula III:

III

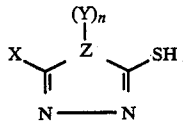

wherein X is selected from a group consisting of hydrogen amino, hydroxyl, hydrazino, alkyl, alkenyl, cycloalkyl, aryl, —$NHCOR_1$, —$NHSO_2R_1$, and —$R_2S$ group; Y is selected from a group consisting of hydrogen, amino, alkyl, alkenyl, cycloalkyl, aryl, —$CONHR_5$, —$COR_4$ group, a —$NHCOR_5$ group or —$NHSO_2R_5$ group; Z is nitrogen, sulfur or oxygen; n is 1 when Z is nitrogen and 0 when Z is oxygen or sulfur; and $R_1$, $R_2$, $R_3$, $R_4$ and $R_5$ are independently selected from a group consisting of alkyl, alkenyl, cycloalkyl and aryl;

processing for a maximum of 90 seconds with said color developer, and removing developed silver and undeveloped silver halide with a bleaching solution and a fixing solution or with a bleach-fixing solution.

2. The method of claim 1, wherein $Z_1$ and $Z_2$ independently represent a group of atoms necessary to complete a heterocyclic ring selected from a group consisting of a thiazole ring, a benzothiazole ring, a selenazole ring, a benzoselenazole ring and a naphthoselenazole ring, wherein said heterocyclic ring may have a substituent.

3. The method of claim 2, wherein $Z_1$ and $Z_2$ independently represent a group of atoms necessary to complete a heterocyclic ring selected from a group consisting of a thiazole, a benzothiazole, a selenazole and a benzoselenazole, wherein said heterocyclic ring may have a substituent.

4. The method of claim 3, wherein $Z_1$ and $Z_2$ both represent a group of atoms necessary to complete a benzothiazole which may have a substituent.

5. The method of claim 1, wherein $R_1$ and $R_2$ independently represent a substituted or unsubstituted alkyl group having 1 to 6 carbon atoms.

6. The method of claim 5, wherein $R_1$ and $R_2$ independently represent an ethyl group, a propyl group or a butyl group.

7. The method of claim 1, wherein at least one of $R_1$ and $R_2$ represents a carboxyalkyl group or a sulphoalkyl group.

8. The method of claim 5, wherein at least one of $R_1$ and $R_2$ represents a carboxyalkyl group or a sulphoalkyl group.

9. The method of claim 8, wherein $R_3$ is hygrogen, methyl or ethyl.

10. The method of claim 1, wherein $R_{21}$ and $R_{22}$ are both ethyl groups.

11. The method of claim 1, wherein said compound represented by formula [II] is selected from a group consisting of a N,N-dimethylhydroxylamine, a N,N-diethylhydroxylamine, a N,N-dipropylhydroxylamine, a N,N-dibutylhydroxylamine and water soluble salts of these compounds.

12. The method of claim 1, wherein said nitrogen-containing heterocyclic mercapto compound is present either in said color developer solution or in said light-sensitive silver halide photographic material.

13. The method of claim 12, wherein said nitrogen-containing heterocyclic mercapto compound is present in said light sensitive silver halide photographic material.

14. The method of claim 13, wherein said nitrogen-containing heterocyclic mercapto compound is present in said light-sensitive silver halide photographic material at an amount of $10^{-8}$ to $10^{-4}$ mol per $m^2$ thereof.

15. The method of claim 13, wherein said nitrogen-containing heterocyclic mercapto compound is present in said light-sensitive silver halide photographic material at an amount of $10^{-7}$ to $10^{-5}$ mol per $m^2$ thereof.

16. The method of claim 1, wherein said hydroxylamine compound is present in said color developer solution and said nitrogen-containing heterocyclic mercapto compound is present in said light-sensitive silver halide photographic material.

17. A method of forming a dye image by the use of a light-sensitive silver halide color photographic material comprising a support and, provided thereon, at least one silver halide emulsion layer containing a dye image forming coupler and light-sensitive silver halide grains which are sensitized with a sensitizing dye of general Formula I

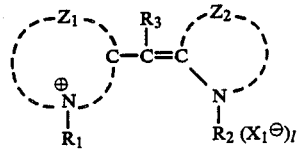

I wherein $Z_1$ and $Z_2$ independently represent a group of atoms necessary to complete a heterocyclic ring consisting of a thiazole, a benzothiazole, a naphthothiazole, a selenazole, a benzoselenazole or a naphthoselenazole, wherein said heterocyclic ring may have a substituent; $R_1$ and $R_2$ are independently selected from a group consisting of alkyl, alkenyl, and aryl; $R_3$ is selected from a group consisting of hydrogen, methyl, and ethyl; $X_1$ is an anion, and l is 0 or 1; with a color developer solution containing an aromatic primary amine color developing agent in the presence of at least one hydroxylamine derivative of general Formula II or a water soluble salt thereof;

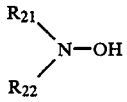

II wherein $R_{21}$ and $R_{22}$ are independently an alkyl group having 1 to 4 carbon atoms which may have a substituent and at least one nitrogen containing heterocyclic mercapto compound selected from mercaptotetrazole and compounds of Formula III:

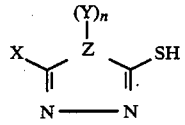

III wherein X is selected from a group consisting of hydrogen, amino, hydroxyl, hydrazino, alkyl, alkenyl, cycloalkyl, aryl, —$NHCOR_1$, —$NHSO_2R_1$, and —$R_2S$ group; Y is selected from a group consisting of hydrogen, amino, alkyl, alkenyl, cycloalkyl, aryl, —$CONHR_3$, —$COR_4$, —$NHCOR_5$ and —$NHSO_2R_5$; Z is nitrogen, sulfur or oxygen; n is 1 when Z is nitrogen and 0 when Z is oxygen or sulfur; and $R_1$, $R_2$, $R_3$, $R_4$ and $R_5$ are independently selected from a group consisting of alkyl, alkenyl, cycloalkyl and aryl;

processing for a maximum of 90 seconds with said color developer, and thereafter removing developed silver and undeveloped silver halide with a bleaching solution and a fixing solution, or with a bleach-fixing solution.

* * * * *